US007478611B2

(12) United States Patent
Yoshida

(10) Patent No.: US 7,478,611 B2
(45) Date of Patent: Jan. 20, 2009

(54) PIPE JOINT

(75) Inventor: Naoki Yoshida, Kanagawa (JP)

(73) Assignee: Piolax, Inc., Yokohama-shi, Kanagawa-ken (JP)

( * ) Notice: Subject to any disclaimer, the term of this patent is extended or adjusted under 35 U.S.C. 154(b) by 286 days.

(21) Appl. No.: 11/109,732

(22) Filed: Apr. 20, 2005

(65) Prior Publication Data

US 2005/0235929 A1 Oct. 27, 2005

(30) Foreign Application Priority Data

Apr. 21, 2004 (JP) ..... P2004-125028

(51) Int. Cl.
*F01P 3/22* (2006.01)
*F01P 7/14* (2006.01)

(52) U.S. Cl. ..... 123/41.1; 123/41.08; 123/41.51

(58) Field of Classification Search ..... 123/41.1, 123/41.43, 41.3, 41.51, 41.08, 41.09, 41.01
See application file for complete search history.

(56) References Cited

U.S. PATENT DOCUMENTS 2,480,986 A * 9/1949 Walker ..... 236/92 C
3,096,748 A * 7/1963 Gordon ..... 123/41.15
4,367,793 A * 1/1983 MacIntosh ..... 165/151
4,434,750 A * 3/1984 Edelmann ..... 123/41.02
4,664,071 A * 5/1987 Geary et al. ..... 123/41.1
5,410,991 A * 5/1995 Beaudry et al. ..... 123/41.1
6,324,759 B1 * 12/2001 Sasano et al. ..... 29/890.03
6,516,906 B2 * 2/2003 Sasano et al. ..... 180/68.4
6,622,666 B2 * 9/2003 Kuji ..... 123/41.1
6,843,209 B2 * 1/2005 Miyagawa et al. ..... 123/41.1
6,978,742 B2 * 12/2005 Miyagawa et al. ..... 123/41.1
7,172,089 B2 * 2/2007 Erich ..... 220/203.06

FOREIGN PATENT DOCUMENTS

JP 2001-241882 9/2001
JP 2003-021287 1/2003

* cited by examiner

*Primary Examiner*—Hai H Huynh
(74) *Attorney, Agent, or Firm*—McGinn IP Law Group, PLLC

(57) ABSTRACT

A pipe joint for a radiator includes a connector portion, a pipe portion, a radiator hose fitting portion, and a radiator cap. The connector portion is connected to a coolant water introducing pipe of the radiator. The pipe portion extends upward from the connector portion. The radiator hose fitting portion extends from the pipe portion. The radiator hose fitting portion is connected to a radiator hose for returning coolant water from an internal combustion engine to the radiator. The radiator cap is mounted on an upper portion of the pipe portion.

20 Claims, 6 Drawing Sheets

PIPE JOINT

BACKGROUND OF THE INVENTION

1. Field of the Invention

The present invention relates to a pipe joint, which couples to the relevant radiator a radiator hose for returning coolant water from an internal combustion engine to a radiator.

2. Description of the Related Art

Coolant water, which has been heated by heat of an engine in an automobile or the like, is conveyed to a radiator by way of a radiator hose at a return side, and cooled in the radiator by natural ventilation and fan. Thereafter, the coolant water is supplied again to the engine by way of a radiator hose at a supply side.

Generally, the radiator hose at the return side is coupled to an upper portion of the radiator, and the radiator hose at the supply side is coupled to a lower portion of the radiator. The radiator is separately provided with a coolant water injection port equipped with a radiator cap, in the upper portion thereof. A connecting pipe for connecting a tube, which is coupled to a reservoir tank, is fitted to this coolant water injection port.

As to such piping system of the radiator, JP-A-2001-241882 discloses the following radiator for a vehicle for cooling coolant water for an on-vehicle engine. The radiator includes a plurality of tubes, a header tank, a water injection port. The water coolant flows through the plurality of tubes. The header tank is disposed at both ends of a plurality of the tubes in a longitudinal direction thereof so as to be communicated with the tubes. The water injection port is connected to the header tank. The water injection portion is shifted in position from the header tank in a back and forth direction of the vehicle. The water injection port is engaged with and fixed to the header tank by first locking means, which can be elastically deformed. The water injection port is water-tightly connected to the header tank by means of a first seal member having a ring-like shape, which can be elastically deformed. The plural tubes are made of aluminum, and a tank main body such as the header tank is made of resin. JP-A-2001-241882 further discloses that the tank main body may be made of metal such as aluminum.

By the way, as material for the radiator, brass has been mainly employed in the past, but recently, many radiators have come to be made of aluminum as disclosed in JP-A-2001-241882. Aluminum has excellent rigidity and pressure resistance by nature as compared with brass, and has a great advantage in its light weight. Although brass is more excellent in heat conductivity than aluminum, it would be possible to cure this deficiency by increasing a wall thickness in case where aluminum is employed, and strength of a whole structure can be enhanced, while reducing weight. In recent years, such a radiator that the whole body thereof has been made of aluminum is becoming to be utilized.

SUMMARY OF THE INVENTION

However, in case where the whole body of the radiator has been made of metal such as aluminum, those parts for fitting the radiator hoses or the like must be also made of metal. Accordingly, there has been such a problem that works for molding pipe fitting portions are not so easy, as compared with a case of molding them from resin.

In JP-A-2001-241882, the water injection port is engaged with and fixed to the header tank by locking means, which can be elastically deformed, thereby enabling the water injection port to be easily attached and to be shifted in position in a back and forth direction of the vehicle. However, the above described problem has been unable to be solved in case where the whole body of the radiator has been made of metal, because it has been necessary to connect the radiator hoses to the radiator separately.

In view of the aforementioned problems, the invention provides a pipe joint, which can further simplify a structure of a pipe fitting portion of a radiator.

In order to attain this object, according to one embodiment of the invention, a pipe joint for a radiator includes a connector portion, a pipe portion, a radiator hose fitting portion, and a radiator cap. The connector portion is connected to a coolant water introducing pipe of the radiator. The pipe portion extends upward from the connector portion. The radiator hose fitting portion extends from the pipe portion. The radiator hose fitting portion is connected to a radiator hose for returning coolant water from an internal combustion engine to the radiator. The radiator cap is mounted on an upper portion of the pipe portion.

With this configuration, when (a) the connector portion of the pipe joint coupled to the coolant water introducing pipe of the radiator and (b) the radiator hose for returning the coolant water from the internal combustion engine to the radiator, is connected with the radiator hose fitting portion, it is possible to connect the radiator with the radiator hose. Moreover, it is possible to provide the water injection port at the same time, because the radiator cap is mounted on the upper portion of the vertical pipe portion. As a result, it is possible to simplify the structure of the pipe fitting portion of the radiator, and to decrease difficulty in molding works in case where the whole body of the radiator is made of metal.

According to one embodiment of the invention, the radiator hose fitting portion may be arranged at a higher position than the connector portion.

With this configuration, after the coolant water flowing from the radiator hose has collided against a wall of the pipe portion, the coolant water falls down inside the pipe portion, and enters through the connector portion into the coolant water introducing pipe of the radiator. Consequently, bubbles contained in the coolant water are separated there from when the coolant water collides against the wall of the pipe portion or falls down. Also, the bubbles contained in the coolant water escape to the upper portion of the vertical pipe portion to be discharged from the radiator cap. As a result, it is possible to prevent the bubbles from remaining in the coolant water, and prevent deterioration of thermal conductivity.

According to one embodiment of the invention, the pipe joint may further include an adaptor ring having a connecting pipe to a reservoir tank. The adaptor ring is attached to an upper end of the vertical pipe portion. The radiator cap may be mounted on the adaptor ring.

With this configuration, the adaptor ring on which the radiator cap is mounted has the connecting pipe to the reservoir tank. Therefore, it is possible to convey the coolant water in the radiator to the reservoir tank or to convey the coolant water in the reservoir tank to the radiator by means of a pressure valve or a vacuum valve provided on the radiator cap in accordance with the pressure inside the radiator, thereby to control the pressure inside the radiator. Moreover, because of necessity of providing a valve seat to be contacted with the valve mechanism of the radiator cap, it is here to fore necessary to make an opening in the adaptor ring small. However, in the above-described configuration, it is possible to make an inner diameter of the vertical pipe portion larger, because the adaptor ring can be attached to the upper end of the pipe portion, as a separate member. Consequently, flow resistance of the coolant water flowing into the pipe portion from the radiator hose will not be increased.

According to one embodiment of the invention, an angle between the radiator hose fitting portion and the connector portion in a plan view may be in a range of from 90 degrees to 180 degrees.

With this configuration, it is possible to set a fitting angle of the radiator hose depending on circumstances of installation of other devices around the radiator, thus enabling piping works to be conducted easily.

According to one embodiment of the invention, the radiator hose fitting portion may project from a peripheral wall of the pipe portion. The protruding portion maybe formed at a base portion of the radiator hose fitting portion. The protruding portion may be configured so that when the radiator hose is fitted to the radiator hose fitting portion, the protruding portion and the peripheral wall of the pipe portion restrict a distal end of the radiator hose.

With this configuration, when the radiator hose is fitted to the radiator hose fitting portion, the distal end of the radiator hose abuts against the protruding portion and the peripheral wall of the vertical pipe portion, there by to restrict an inserting position of the distal end portion of the radiator hose. Therefore, it is possible to reliably insert the radiator hose up to a predetermined position. Moreover, it would be sufficient to provide the protruding portion on the peripheral wall of the pipe portion. Therefore, a shape of the pipe joint can be simplified, a molding die can be easily produced, and cost for resin material can be reduced.

According to embodiments of the invention, both the radiator hose and the water injection port can be fitted to the single pipe fitting portion, which is provided on the radiator. As a result, it is possible to simplify the structure of the pipe fitting portion of the radiator, and difficulties in molding works can be decreased in case where the whole body of the radiator is made of metal.

BRIEF DESCRIPTION OF THE DRAWINGS

FIG. 2 shows the pipe joint according to an embodiment of the invention, in which

DETAILED DESCRIPTION OF THE PREFERRED EMBODIMENT

Figure 1:
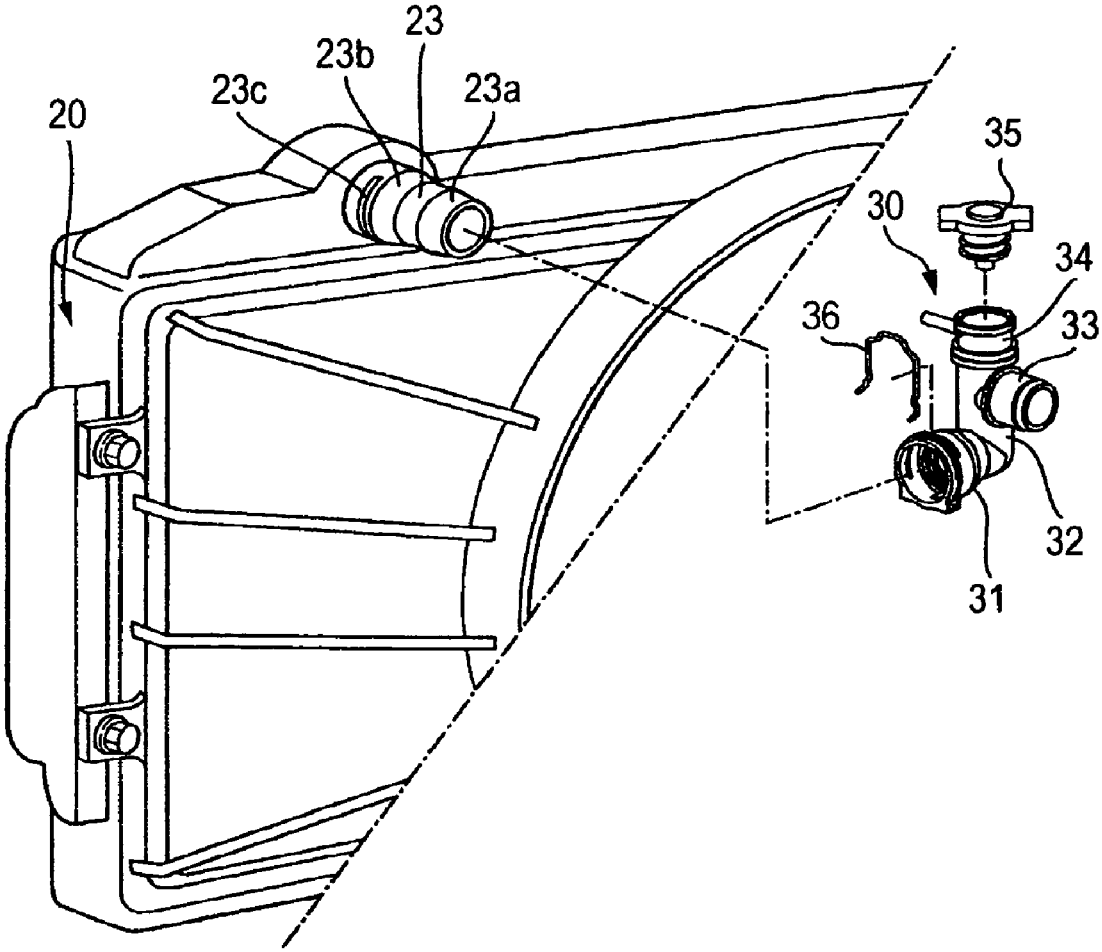
FIG. 1 is an explanatory view showing an arrangement of a pipe joint according to an embodiment of the invention and a coolant water introducing pipe of a radiator.
Figure 2A:
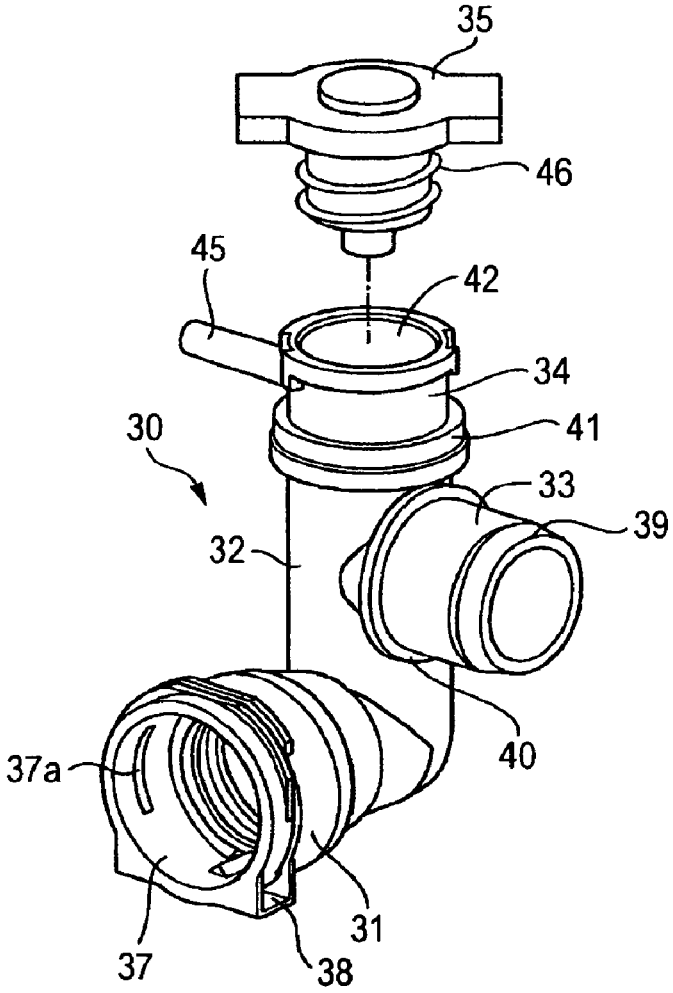
FIG. 2A is a perspective view.
Figure 2B:
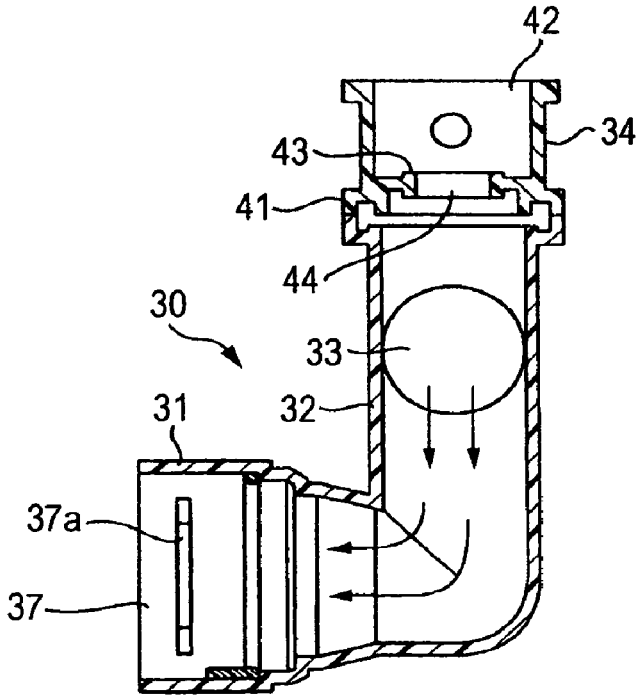
FIG. 2B is a sectional view.
Figure 3:
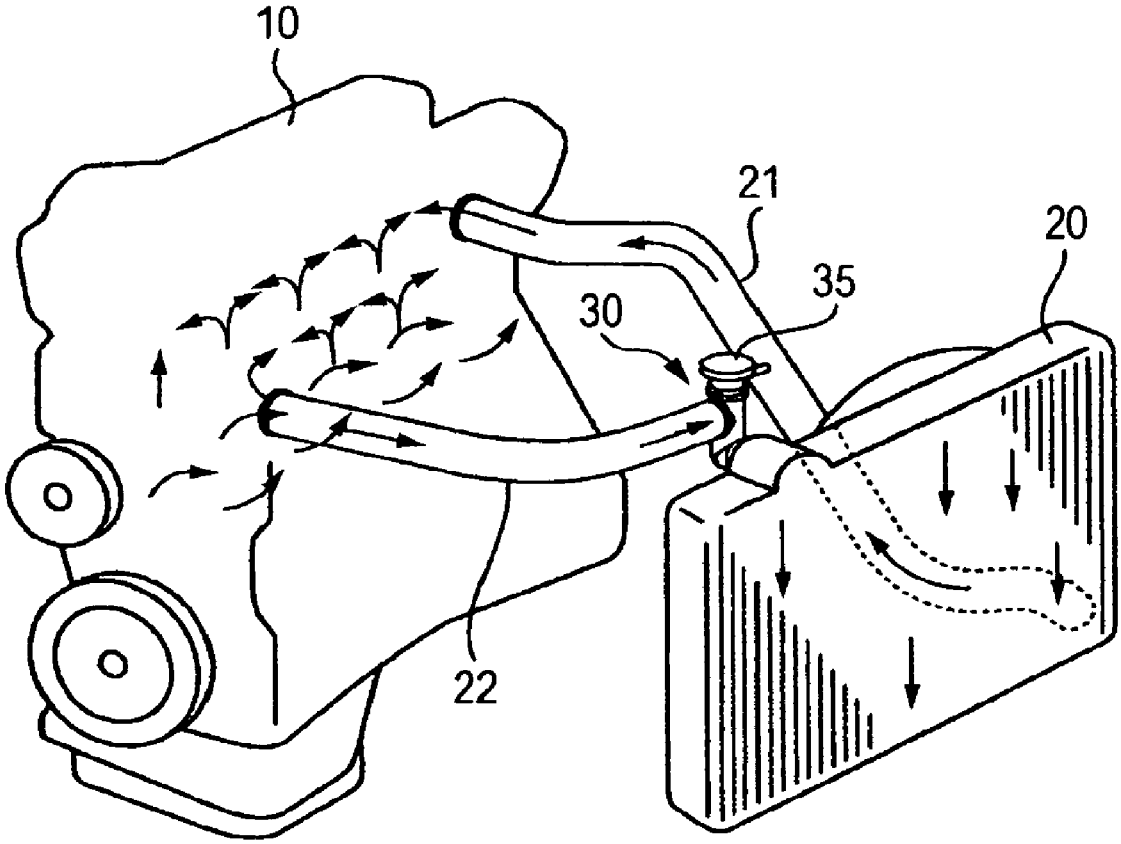
FIG. 3 is a perspective view showing a state where an engine and the radiator are connected by radiator hoses with using the pipe joint according to the embodiment of the invention.

Now, embodiments of the invention will be described by referring to the accompanied drawings. FIGS. 1 to 3 show a pipe joint according to an embodiment of the invention.

As shown in FIG. 3, an engine 10 is connected to a radiator 20 by means of radiator hoses 21 and 22. The radiator hose 21 at a coolant water supply side is coupled, at its one end, to a lower portion of the radiator 20, and coupled, at the other end, to the engine 10. The radiator hose 22 at a coolant water return side is coupled, at its one end, to the engine 10, and coupled, at the other end, to an upper portion of the radiator 20 by means of a pipe joint 30 according to this embodiment.

The coolant water is supplied from the radiator 20 to the engine 10 through the radiator hose 21 at the supply side, as shown by an arrow in FIG. 3. The coolant water, which has been heated while passing through the engine 10, is returned to the radiator 20 through the radiator hose 22 at the return side, by way of the pipe joint 30 according to this embodiment.

As shown in FIG. 1, the radiator 20 is provided with a coolant water introducing pipe 23 formed on a back face in the upper portion thereof. This coolant water introducing pipe 23 has a distal end portion 23*a*, which is reduced in diameter; a taper portion 23*b*, which is enlarged in diameter in a taper shape, at a base end side of the distal end portion 23*a*; and an annular groove 23*c* at the base end side of the taper portion 23*b*.

The pipe joint 30 according to this embodiment includes a connector portion 31 to be connected to the coolant water introducing pipe 23; a pipe portion 32 extending upward from the connector portion 31; a radiator hose fitting portion 33, which projects laterally from a peripheral wall of the pipe portion 32; and a radiator cap 35, which is mounted on an upper end of the pipe portion 32 via an adapter ring 34. A stopper 36 formed of a wire, which is bent in a gate-like shape, is fitted to the connector portion 31.

Referring also to FIG. 2, the connector portion 31 defines an insertion hole 37 into which the coolant water introducing pipe 23 is adapted to be inserted. A peripheral wall of the insertion hole 37 has arc-shaped slits 37*a* into which the stopper 36 is inserted. The connector portion 31 defines recesses 38, with which both ends of the stopper 36 are engaged, on its outer peripheral face thereof. When the coolant water introducing pipe 23 of the radiator 20 is inserted into the insertion hole 37, portions of the stopper 36 projecting inwardly through the slits 37*a* are engaged with the annular groove 23*c* of the coolant water introducing pipe 23, whereby the connector portion 31 is be retained. Such a structure of the connector portion 31 has been already publicly known. It is possible for this embodiment to adopt a structure disclosed in JP-A-2003-21287, entire contents of which are incorporated herein by reference.

The radiator hose fitting portion 33 projects laterally from the peripheral wall of the pipe portion 32. When an end of the radiator hose 22 at the return side is inserted into the radiator hose fitting portion 33, the radiator hose 22 is connected to the pipe joint 30. A distal end portion 39 of the radiator hose fitting portion 33 is reduced in diameter in a taper shape, so that the radiator hose 22 can be easily fitted thereto. Moreover, a flange 40 is formed on a base end of the radiator hose fitting portion 33, to position the distal end of the radiator hose 22 when the radiator hose 22 is fitted thereto.

A base portion 41 of the adapter ring 34 is joined by welding to an opening defined at the upper end of the pipe portion 32. A connecting pipe 45 to be connected to a reservoir tank, which is not shown, is additionally provided on a peripheral wall of the adapter ring 34 so as to protrude outwardly. A tube connected to the reservoir tank, which is not shown, is adapted to be coupled to this connecting pipe 45.

An opening at an upper end of the adapter ring 34 is defined as a water injection port 42, on which the radiator cap 35 is adapted to be mounted. The radiator cap 35 has a male thread 46 on a portion thereof to be inserted. The adaptor ring 34 is formed with a female thread, which is not shown, on an inner peripheral face thereof, the female thread being adapted to be screwed with the male thread 46. The adaptor ring 34 is further provided, on an inner periphery of a lower portion thereof, with a valve seat 43 with which a valve body of the radiator cap 35, which is not shown, is adapted to be contacted. A communication hole 44 is defined at a center of this valve seat 43.

Now, operation of the pipe joint 30 will be described.

In order to couple the radiator hose 22 at the return side for returning the coolant water from the engine 10 to the radiator 20, to the coolant water introducing pipe 23 of the radiator 20, one end of the radiator hose 22 is fitted to the radiator hose fitting portion 33 of the pipe joint 30, as a first step. Then, the radiator hose 22 is fixed by a hose band or the like, which is not shown.

In this state, the coolant water introducing pipe 23 of the radiator 20 is inserted into the insertion hole 37 of the connector portion 31. Then, the stopper 36 is pressed to be enlarged, and thereafter, engaged with the annular groove 23*c* of the coolant water introducing pipe 23, whereby the connector portion 31 of the pipe joint 30 is coupled to the coolant water introducing pipe 23.

The pipe joint 30 is so constructed that the radiator cap 35 is mounted on the upper portion of the pipe portion 32 via the adaptor ring 34, and that the coolant water can be introduced from the water injection port 42 by detaching this radiator cap 35. Moreover, when the tube connected to the reservoir tank is coupled to the connecting pipe 45, which is formed on the adaptor ring 34, piping connection to the reservoir tank can be performed.

Therefore, according to this pipe joint 30, when the pipe joint 30 is attached to the radiator 20, the water injection portion 42 and the radiator cap 35 can be simultaneously attached to the radiator 20 through the coolant water introducing pipe 23 formed on the radiator 20. Therefore, it is possible to reduce number of pipe fitting portions of the radiator 20, and to decrease difficulties in molding works in a case where the whole body of the radiator 20 is made of metal.

In addition, by appropriately setting a projecting direction of the radiator hose fitting portion 33 with respect to the pipe portion 32, it is possible to connect the radiator hose 22 to the radiator 20 at a desired angle. As a result, it is possible to arrange the radiator hose 22 without interfering with devices installed around the radiator, thereby further facilitating the piping work.

Preferably, an angle of arranging the radiator hose fitting portion 33 with respect to the connector portion 31 (that is, an angle between the radiator hose fitting portion 33 and the connector portion 31) is set to be 90 to 180 degree, as seen in a plan view. In this manner, a mounting angle of the radiator hose 22 with respect to the radiator 20 can be set in a range from a right angle to a parallel angle, so that it is possible to set piping arrangement of the radiator hose 22 in an optimum condition.

Further, in this embodiment, the radiator hose fitting portion 33 is provided at a higher position than the connector portion 31. For this reason, as shown in FIG. 2B, the coolant water flowing from the radiator hose fitting portion 33 enters into the pipe portion 32 and collides against an inner wall of the pipe portion 32. Thereafter, the coolant water falls downward, and after colliding again against a bent portion where the connector portion 31 and the pipe portion 32 are connected to each other, the coolant water flows through the connector portion 31 into the coolant water introducing pipe 23 of the radiator 20.

In this manner, in a passage of the coolant water, there are provided the walls, which the coolant water collides against, and stepped portions for making the coolant water fall down from a predetermined height. Thus, bubbles contained in the coolant water easily flow out at a shock of collision. The bubbles, which have flown out, float upward in the pipe portion 32, and are discharged to, for example, the reservoir tank by means of a valve mechanism (not shown) in the radiator cap 35. Consequently, such phenomenon that the bubbles remaining in the coolant water may cause pressure variation can be prevented.

Figure 4:
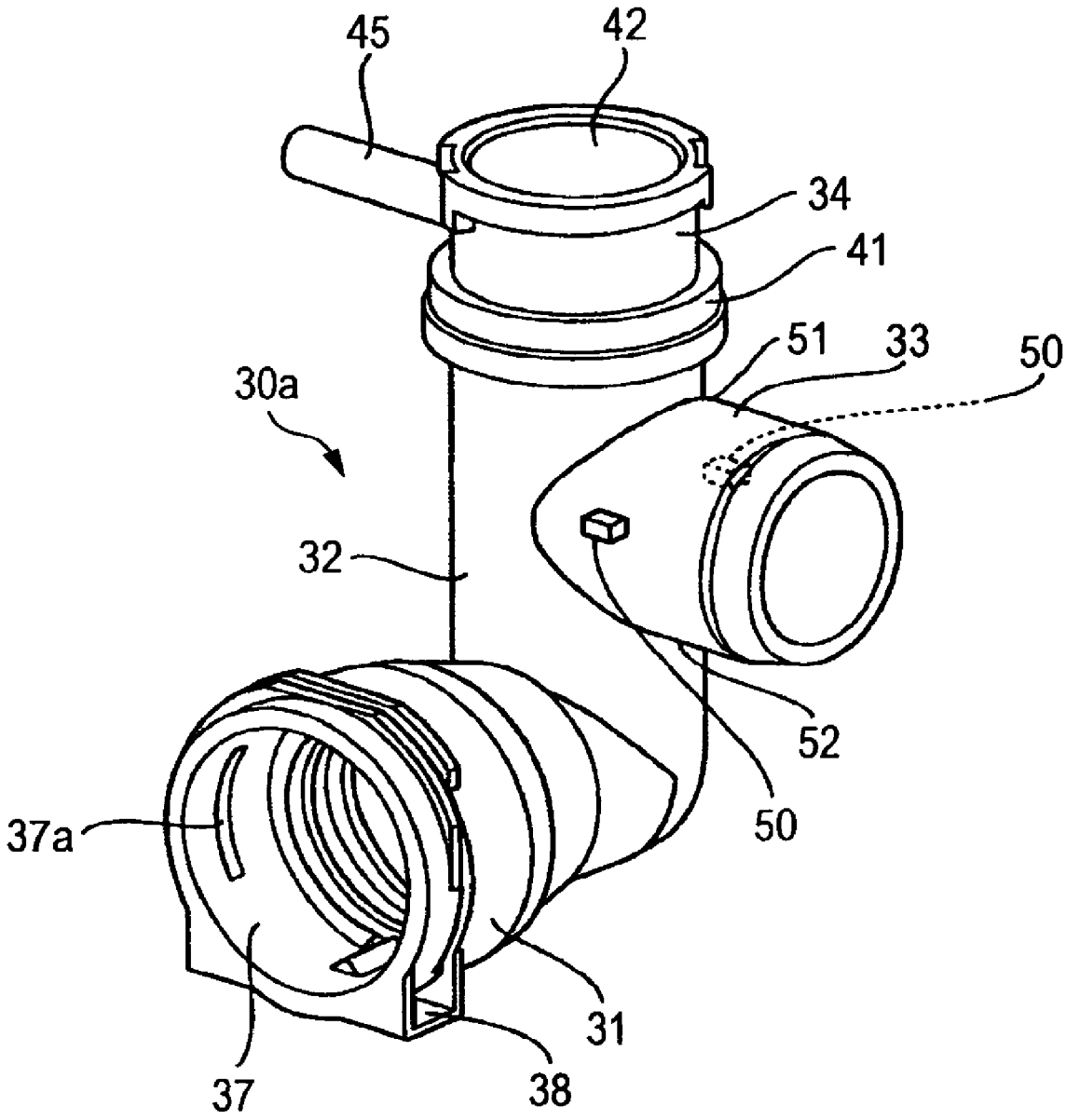
FIG. 4 is a perspective view of a pipe joint according to another embodiment of the invention.

FIG. 4 shows a pipe joint 30*a* according to another embodiment of the invention. The pipe joint 30*a* of this embodiment has essentially the same structure as the pipe joint 30 as shown in FIGS. 1 to 3. Therefore, the same components will be denoted by the same reference numerals, and their description will be omitted. It is to be noted that this is applied also to the succeeding embodiments.

The pipe joint 30*a* of this embodiment is different from the pipe joint 30 of the foregoing embodiment in that a pair of protruding portions 50 are formed at a position adjacent to the base end of the radiator hose fitting portion 33. The protruding portions 50 are provided at horizontally opposed positions on a peripheral wall of the radiator hose fitting portion 33. The protruding portions 50 are located at substantially same positions as upper and lower corners 51, 52 where the radiator hose fitting portion 33 is merged with the pipe portion 32. In other words, the protruding portions 50 are located on a virtual circle passing through the uppermost corner 51 and lowermost corner 52 of the radiator hose fitting portion 33.

These protruding portions 50 function as substitutes for the annular flange 40 in the foregoing embodiment. When the radiator hose 22 has been fitted thereto, the distal end of the radiator hose 22 comes into contact with the protruding portions 50 and the peripheral wall of the pipe portion 32, thereby serving to restrict the fitting position of the radiator hose 22. By providing, in this manner, the protruding portions 50 in place of the flange 40, a shape of the pipe joint 30*a* can be simplified, and the molding die and so on can be designed easier. Moreover, cost for resin material can be reduced.

Figure 5A:
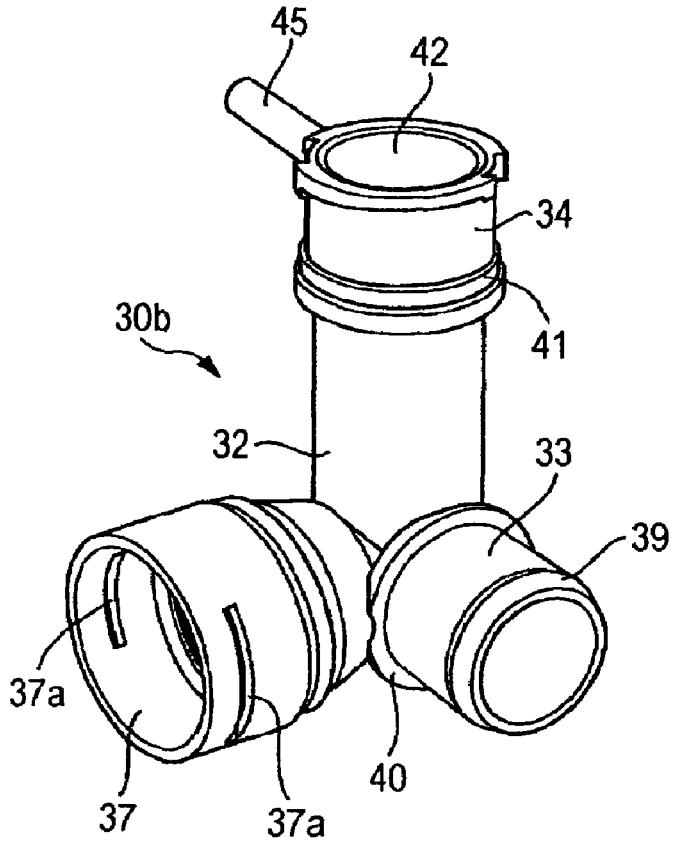
FIGS. 5A-5B are perspective views of a pipe joint according to a further embodiment of the invention.
Figure 5B:
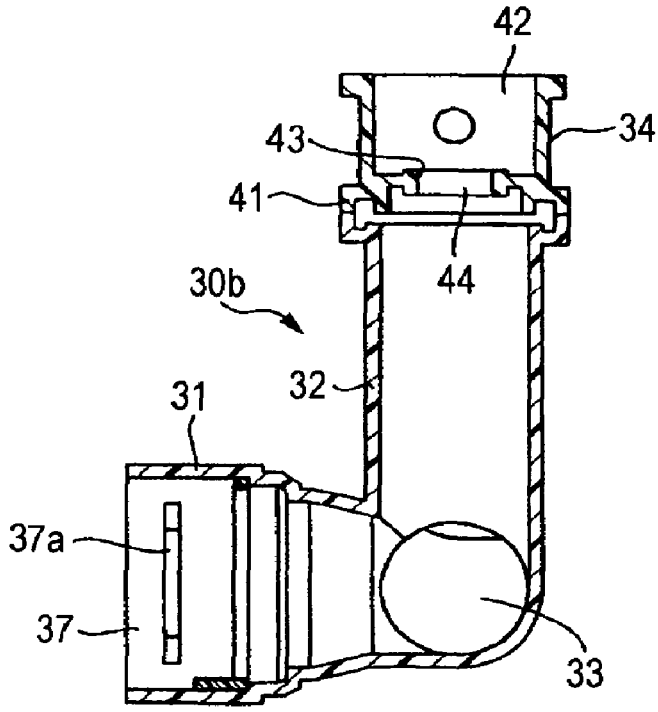

FIG. 5 shows a further embodiment of the invention. A pipe joint 30*b* of this embodiment is different from those of the foregoing embodiments in that the radiator hose fitting portion 33 is connected to the pipe portion 32 at the same level as the connector portion 31. In this embodiment, because the radiator hose fitting portion 33 is located close to the connector portion 31, the radiator hose 22 can come close to the coolant water introducing pipe 23 of the radiator 20, and rigidity of the connected parts can be enhanced.

Figure 6A:
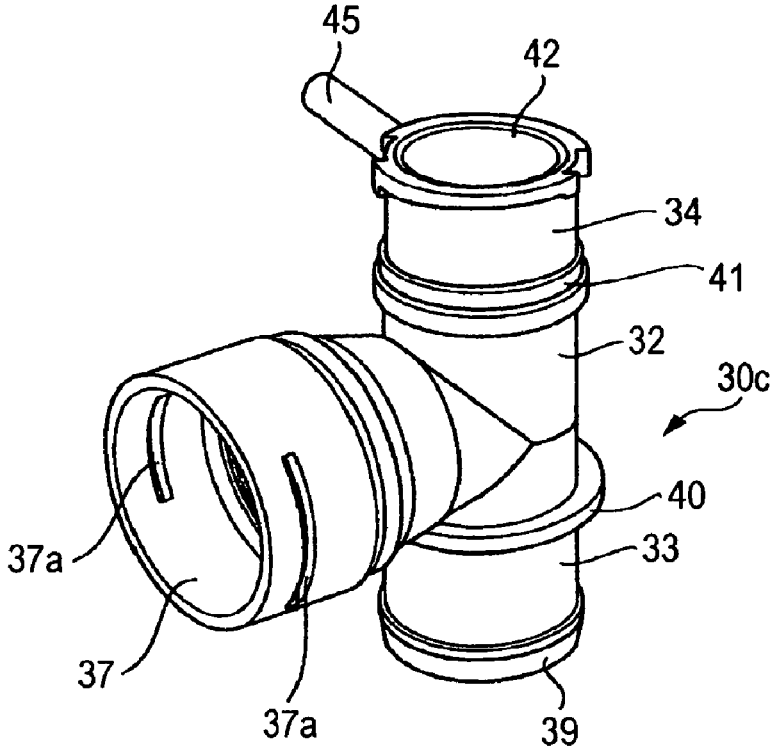
FIGS. 6A-6B are perspective views of a pipe joint according to a still further embodiment of the invention.
Figure 6B:
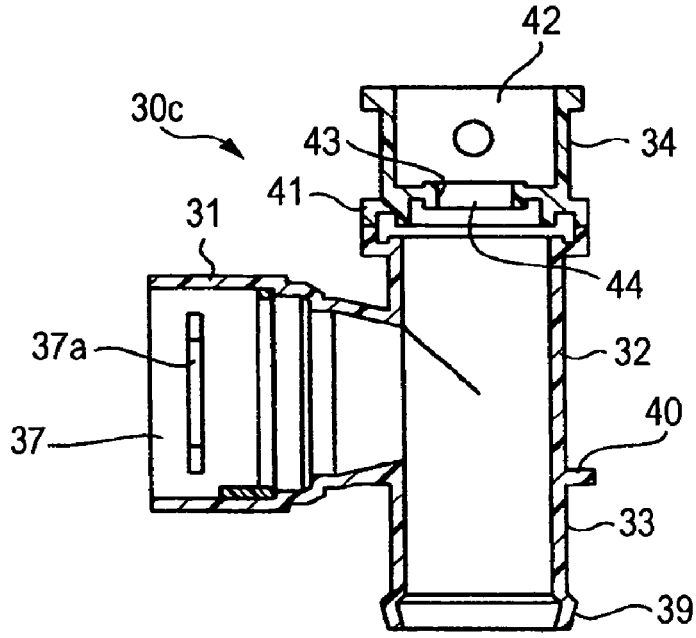

FIG. 6 shows a still further embodiment of the invention. In a pipe joint 30*c* of this embodiment, the radiator hose fitting portion 33 is provided in a lower end part of the pipe portion 32. Consequently, the radiator hose 22 is adapted to be coupled to the radiator hose fitting portion 33 of the pipe joint 30*c* from below. Because the pipe portion 32 and the radiator hose fitting portion 33 are formed of a single concentric pipe, a shape of this pipe joint 30*c* is simplified, thus enabling the molding work to be easily conducted, and the design of the molding die can be made easier.

By varying in this manner the direction of the radiator hose fitting portion 33 and/or the position of the radiator hose fitting portion 33, it is possible to arrange the radiator hose according to an installing space, which is defined by the other devices surrounding the radiator 20.

The pipe joint according to the invention can be utilized as the pipe joint, which can couple to the radiator the radiator hose for returning the coolant water from the internal combustion engine to the radiator, and at the same time, can function as the water injection port on which the radiator cap is mounted.

What is claimed is:

1. A pipe joint for a radiator, comprising:

a connector portion for connecting to a coolant water introducing pipe of the radiator;

a pipe portion that extends upward from the connector portion;

a radiator hose fitting portion that extends from the pipe portion, the radiator hose fitting portion being connectable to a radiator hose for returning coolant water from an internal combustion engine to the radiator;

a radiator cap that is mounted on an upper portion of the pipe portion; and a bent portion for connecting the connector portion to the pipe portion, the connector portion extending laterally from the pipe portion.

2. The pipe joint according to claim 1, wherein the radiator hose fitting portion is arranged at a higher position than the connector portion.

3. The pipe joint according to claim 2, further comprising:

an adaptor ring for attachment to an upper end of a pipe portion that extends upward, comprising a connecting pipe to a reservoir tank, wherein the radiator cap is mounted on the adaptor ring.

4. The pipe joint according to claim 1, further comprising:

an adaptor ring for attachment to an upper end of a pipe portion that extends upward, comprising a connecting pipe to a reservoir tank, wherein the radiator cap is mounted on the adaptor ring.

5. The pipe joint according to claim 4, wherein the adaptor ring further comprises a base portion that is weldable to the pipe portion.

6. The pipe joint according to claim 1, wherein an angle between the radiator hose fitting portion and the connector portion in a plan view comprises a range of from 90 degrees to 180 degrees.

7. The pipe joint according to claim 1, wherein the radiator hose fitting portion projects from a peripheral wall of the pipe portion;

wherein a protruding portion is formed at a base portion of the radiator hose fitting portion; and wherein the protruding portion is configured such that when the radiator hose is fitted to the radiator hose fitting portion, the protruding portion and the peripheral wall of the pipe portion restrict a distal end of the radiator hose.

8. The pipe joint according to claim 1, wherein the radiator hose fitting portion comprises an offset position from that of the connector portion.

9. The pipe joint according to claim 1, further comprising:

a pair of protruding portions formed at a base portion of the radiator hose fitting portion, wherein the pair of protruding portions are configured such that when the radiator hose is fitted to the radiator hose fitting portion, the protruding portion and the peripheral wall of the pipe portion restrict a distal end of the radiator hose.

10. The pipe joint according to claim 9, wherein the pair of protruding portions are provided at horizontally opposed positions on the peripheral wall of the radiator hose fitting portion.

11. The pipe joint according to claim 1, wherein the pipe joint further comprises resin.

12. The pipe joint according to claim 1, wherein the radiator hose fitting portion is arranged at a same position as the connector portion.

13. The pipe joint according to claim 12, wherein the radiator hose fitting portion and the connector portion are disposed at a right angle to one another.

14. The pipe joint according to claim 1, wherein the radiator hose fitting portion is arranged at a lower position than the connector portion.

15. The pipe joint according to claim 14, wherein the pipe portion comprises a flange disposed at a position above the radiator hose fitting portion.

16. The pipe joint according to claim 1, wherein the radiator hose fitting portion comprises a tapered distal end that receives a radiator hose.

17. The pipe joint according to claim 1, wherein said radiator hose fitting portion projects laterally from a peripheral wall of the pipe portion.

18. The pipe joint according to claim 1, wherein the radiator hose fitting portion is provided at a same position as the bent portion.

19. A pipe joint for a radiator, comprising:

a connector portion for connecting to a coolant water introducing pipe of the radiator;

a pipe portion that extends upward from the connector portion;

a radiator hose fitting portion that extends from the pipe portion, the radiator hose fitting portion being connectable to a radiator hose for returning coolant water from an internal combustion engine to the radiator; and a radiator cap that is mounted on an upper portion of the pipe portion, wherein the connector portion is connected to the pipe portion at a right angle.

20. A pipe joint for a radiator, comprising:

a connector portion for connecting to a coolant water introducing pipe of the radiator;

a pipe portion that extends upward from the connector portion;

a radiator hose fitting portion that extends from the pipe portion and is disposed in a position where coolant water collides against an inner wall of the pipe portion, the radiator hose fitting portion being connectable to a radiator hose for returning the coolant water from an internal combustion engine to the radiator;

a radiator cap that is mounted on an upper portion of the pipe portion; and a bent portion for connecting the connector portion to the pipe portion, the connector portion extending laterally from the pipe portion.

* * * * *